US006319158B1

(12) United States Patent
Cheng

(10) Patent No.: US 6,319,158 B1
(45) Date of Patent: Nov. 20, 2001

(54) GAME RACKET WITH ELONGATED SLOT IN YOKE PORTION

(75) Inventor: Po-Jen Cheng, Oak Brook, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/561,840

(22) Filed: Apr. 28, 2000

(51) Int. Cl.[7] ..... A63B 49/02

(52) U.S. Cl. ..... 473/522; 473/539; 473/540; 473/543; 473/546

(58) Field of Search ..... 473/520, 521, 473/522, 524, 533, 537, 539, 540, 543, 546

(56) References Cited

U.S. PATENT DOCUMENTS

| | | | | |
|---|---|---|---|---|
| 4,681,319 | * | 7/1987 | Zilinskas | 473/540 |
| 4,828,259 | * | 5/1989 | Davis | 473/522 |
| 5,141,228 | * | 8/1992 | Soong | 473/521 |
| 5,178,386 | * | 1/1993 | Tzeng | 473/521 |
| 5,702,313 | | 12/1997 | Stennett . | |
| 6,027,420 | * | 2/2000 | Soong | 473/540 |

FOREIGN PATENT DOCUMENTS

2226250 * 6/1990 (GB) ..... 473/FOR 181

OTHER PUBLICATIONS

Siegfried Kuebler, *Book of Tennis Rackets from the beginning of the 16th century until about 1990* (2000 English translation of 1995 compendium). pp. 53–54 "Acro: Adjustable 1975" tennis racket.

Siegfried Kuebler, *Book of Tennis Rackets from the beginning of the 16th century until about 1990* (2000 English translation of 1995 compendium). p. 286 "Prince: Classic, 1977", "Prince: Graphite, 1980", "Prince: Pro, 1979" tennis racket.

Siegfried Kuebler, *Book of Tennis Rackets from the beginning of the 16th century until about 1990* (2000 English translation of 1995 compendium). pp. 293–294 "Protagon: Bergelin Longstring, McGregor, ca. 1985" tennis racket.

* cited by examiner

*Primary Examiner*—Raleigh W. Chiu

(57) ABSTRACT

A game racket includes elongated main strings which extend through a slot in a yoke portion of the head. In one embodiment the lower ends of the main strings pass through string holes in a second throat bridge below the first throat bridge. In another embodiment the lower ends of the main strings pass through string holes in the arms of the throat of the racket.

11 Claims, 4 Drawing Sheets

GAME RACKET WITH ELONGATED SLOT IN YOKE PORTION

BACKGROUND

1. Field of the Invention

This invention relates to game rackets and, more specifically, to rackets having elongated apertures in the yoke portion thereof to allow for elongation of the main strings of the racket.

2. Description of the Prior Art

Rackets for tennis and other sports, such as racquetball and squash, typically have one or two lengths of racket strings interwoven to create a mesh pattern. Generally, there are vertically oriented strings known as main strings, and horizontally oriented strings known as cross strings. The main strings and cross strings typically are strung through string holes provided about the perimeter of the head of the racket frame by professionals with equipment provided to obtain desired string tensions.

The frame of a racket often includes a handle, a Y-shaped throat, consisting of a pair of arms that diverge from the handle, and a generally inverted U-shaped head having a top and two sides. The bottom of the head, spanning the legs of the inverted U-shape, is typically occupied by a yoke portion, also known in the art as a throat bridge. While some rackets, such as the Bergelin LongString(TM) by MacGregor, as well as the racket shown in Stennett, U.S. Pat. No. 5,702,313, had strings that extended through string holes provided in the throat bridge, the string holes constrained the strings therein. Stennett's racket purportedly reduced vibrations by increasing the length of the main strings. However, it is actually the case that by increasing the racket string length, the racket string's natural frequency decreases, resulting in more vibration in the string bed.

Because there are benefits to extending the strings through the throat bridge, it would be desirable for a racket to have a throat bridge that could allow racket strings to pass therethrough, while sufficiently dampening the strings to minimize any increased vibration resulting from increased string length. It would be even more desirable if such a racket further decreased vibrations that would have existed in the string bed even if the string length were not increased. Also, it would be desirable for such a racket to be provided with a second bridge positioned beneath the throat bridge to increase the overall racket strength and stability. The second bridge also would provide a convenient point to provide conventional string holes so that the elongated strings could still be looped in the throat portion in a manner that did not require excessively overlength strings.

SUMMARY OF THE INVENTION

A racket is provided with an elongated slot in the yoke or throat bridge that is sufficiently wide to accommodate at least two main strings, and preferably, several more than two main strings. The elongated slot includes means for dampening the string bed in order to at least offset any increased vibrations that may be caused by increasing the string length. In one form of the invention, the dampening means takes the form of a pair of dampening strips, made of a soft damping material such as polyurethane foam, with one of the strips disposed on either side of the string bed within the elongated slot.

In this embodiment, the racket is preferably provided with a second throat bridge beneath the yoke, which second throat portion is provided with apertures therein, which are known in the art as string holes, through which the main strings pass during stringing of the racket.

In an alternate embodiment of the present invention, a racket is provided with the same type of elongated slot in the yoke as the first embodiment, which accommodates at least two, and preferably several more than two, main strings. However, instead of providing strips on either side of the string bed within the elongated slot, in this embodiment the dampening means takes the form of a polyurethane insert that substantially fills the elongated slot. The polyurethane insert is provided with a thin vertical passage for each of the main strings that passes through the elongated slot in the yoke. The thin vertical passage is preferably of a smaller diameter than the string diameter, such that when the racket strings are strung through the vertical passages, a force fit is created between the racket strings and the polyurethane insert.

DETAILED DESCRIPTION OF THE PREFERRED EMBODIMENT

Figure 1:
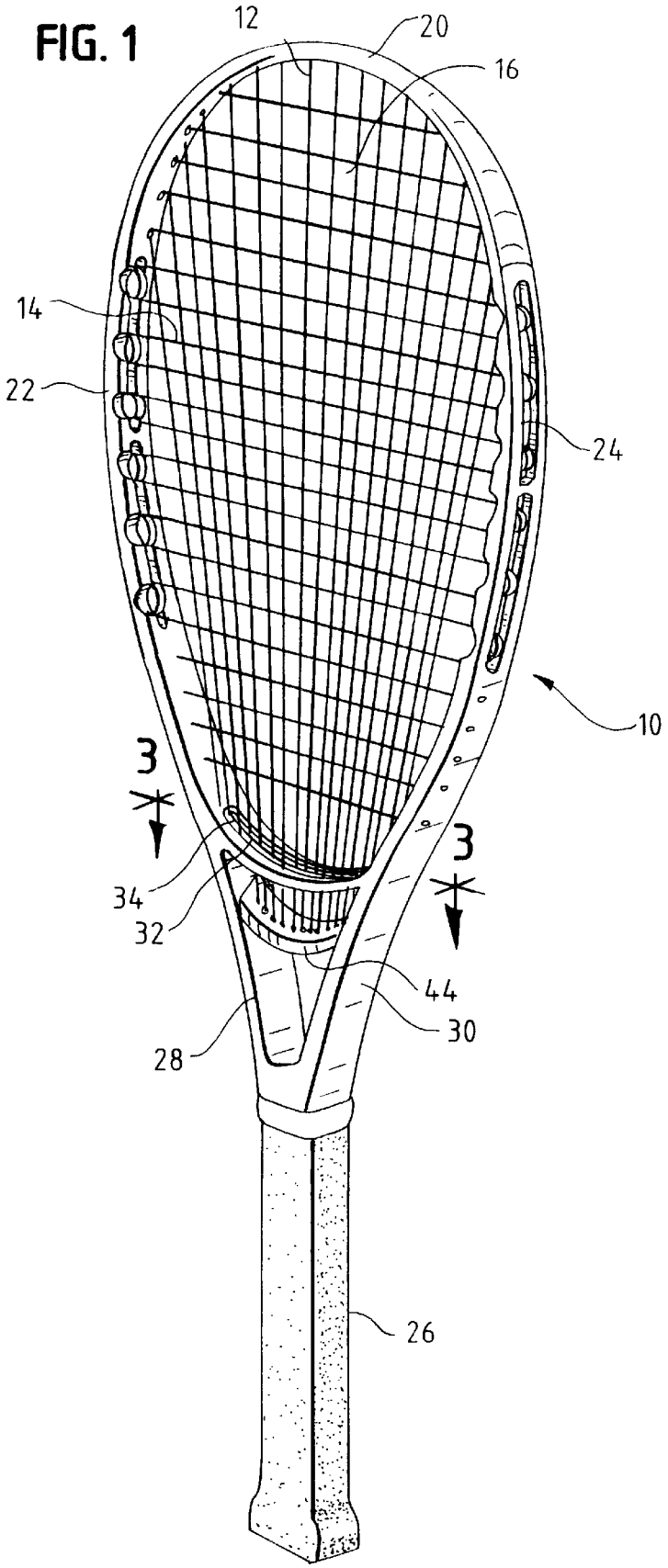
FIG. 1 is a rear perspective view of a first embodiment of a racket of the present invention.
Figure 2:
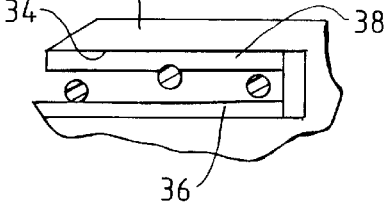
FIG. 2 is an enlarged and partially exploded view, broken away, showing the throat portion of the racket shown in FIG. 1.
Figure 3:
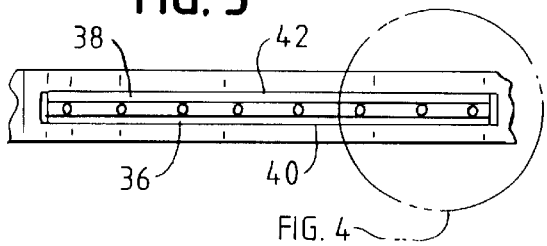
FIG. 3 is a cross-sectional view taken along lines 3—3 of FIG. 1.

The racket 10 of the first embodiment of the present invention has a plurality of main strings 12 and a plurality of cross strings 14. The cross strings 14 are interwoven through the main strings 12 to create a string bed 16. The string bed 16 is substantially bounded by an inverted U-shaped head 18 of the racket, having a top 20 and sides 22, 24. The racket 10 also has a handle 26 and Y-shaped throat having arms 28, 30. The bottom of the head 18 is occupied by a first throat bridge 32, also called a yoke. The first throat bridge 32 includes an elongated vertically oriented slot 34 therethrough. At least two of the main strings 12, and preferably several more than two of the main strings 12, pass through the elongated slot 34 and into the throat portion of the racket 10.

Because increasing the length of the main strings 12 has a tendency to increase string vibrations as a result of decreasing the frequency of the main strings 12, a damping means is provided within the elongated slot 34. The damping means in this embodiment takes the form of a pair of elongated damping strips, 36, 38, made of a suitable racket string damping material such as polyurethane foam.

Figure 4:
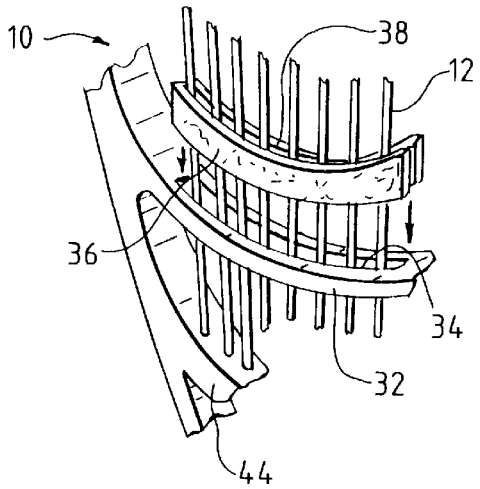
FIG. 4 is an enlarged cross-sectional view taken along line 4 of FIG. 3.
Figure 5:
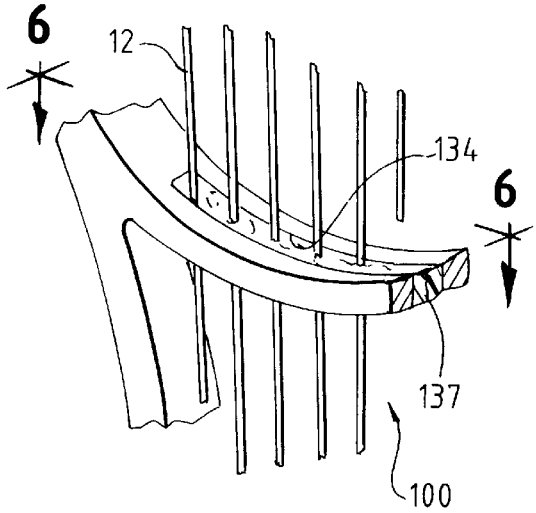
FIG. 5 is an enlarged view, broken away, showing the throat portion of an alternate embodiment of a racket of the present invention.
Figure 6:
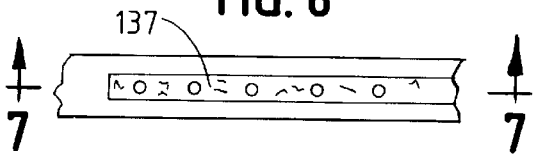
FIG. 6 is a cross-sectional view taken along lines 6—6 of FIG. 5.

Because of the interwoven nature of the cross strings 14 through the main strings 12, the main strings have a tendency to be slightly out of alignment with one another, as indicated in FIG. 4. One of the strips 36 is between the main strings 12 and a first sidewall 40 of the elongated slot 34, and the other strip 34 is located on the opposite side of the main strings 12, between the main strings 12 and a second sidewall 42 of the elongated slot 34. Each of the damping strips 36, 38 is preferably secured to the respective sidewall 40, 42 of the elongated slot 34 by a suitable adhesive.

A second throat bridge 44, connecting the two arms 28, 30 of the throat and oriented under the yoke, is provided. The second throat bridge 44 has string holes 46 therein to accommodate the main strings 12 that extend through the elongated slot 34. The radius of curvature of the second throat bridge is substantially the same as the radius of curvature of the first throat bridge. The second throat bridge is provided with string holes for the main strings for enclosing the lower ends of the main strings.

Figure 7:
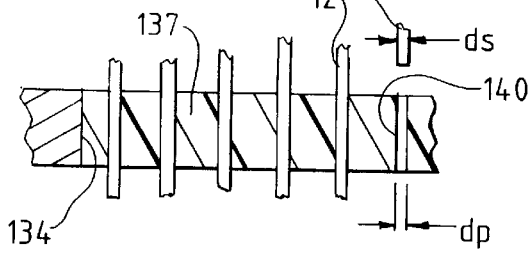
FIG. 7 is a cross-sectional view taken along lines 7—7 of FIG. 6.
Figure 8:
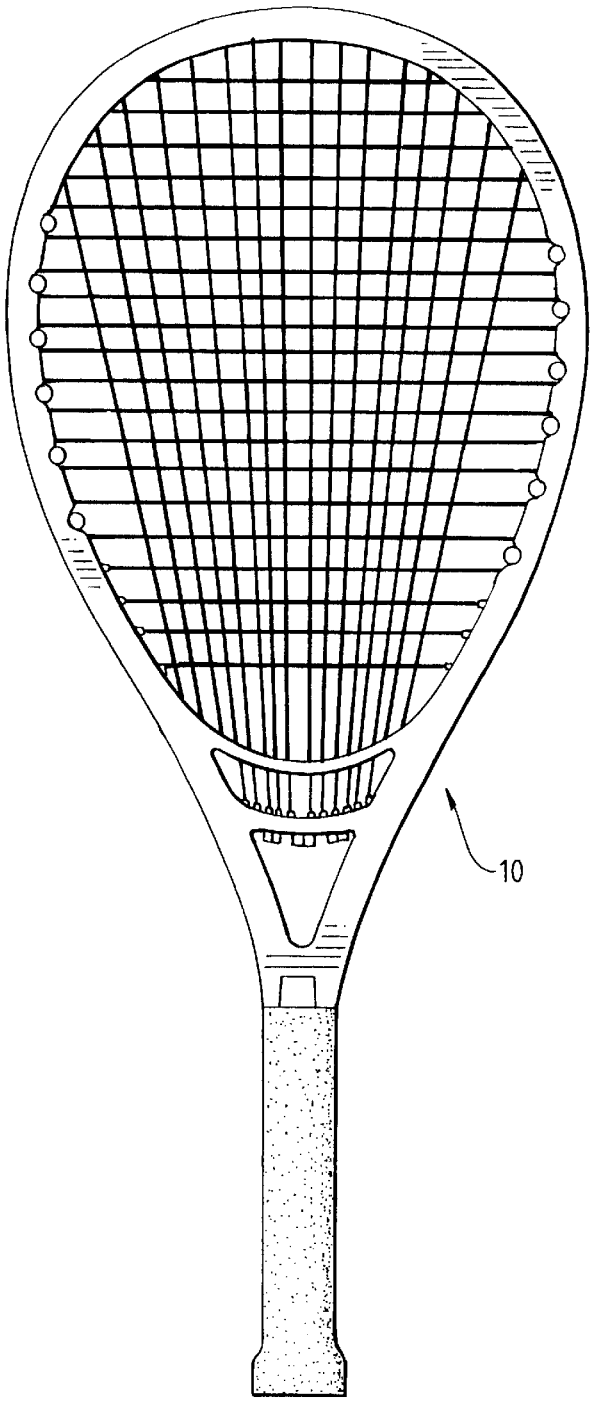
FIG. 8 is a front plan view of the racket shown in FIG. 1.
Figure 9:
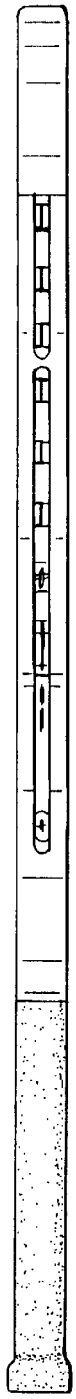
FIG. 9 is a left side view of the rackets shown in FIGS. 8 and 13.
Figure 10:
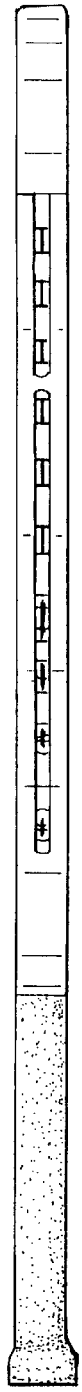
FIG. 10 is a right side view of the rackets shown in FIGS. 8 and 13.
Figure 11:
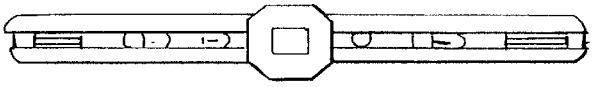
FIG. 11 is a bottom plan view of the rackets shown in FIGS. 8 and 13.
Figure 12:
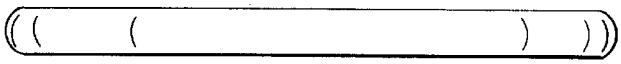
FIG. 12 is a top plan view of the rackets shown in FIGS. 8 and 13.

Turning to FIGS. 5–7 and 13, a racket 100 is shown demonstrating a second embodiment of the present invention. This embodiment also has an elongated slot 134. However, instead of a pair of damping strips 36, 38, this racket 100 utilizes an insert made of a suitable material such as polyurethane as an insert 137 that substantially fills the elongated slot 134. As best shown in FIG. 7, the insert 137 preferably is provided with vertical passages 140, which have a diameter dp that is smaller than the string diameter ds of the main strings 12. As a result, when the main strings 12 pass through the insert 137, there is a force fit created between the main strings and the insert. This helps retain the insert in its desired location, so that players do not have to continually adjust the damper during play.

If desired, a bonding agent can be provided on the outer walls of the insert 137 to retain the insert 137 within the elongated slot 137.

Figure 13:
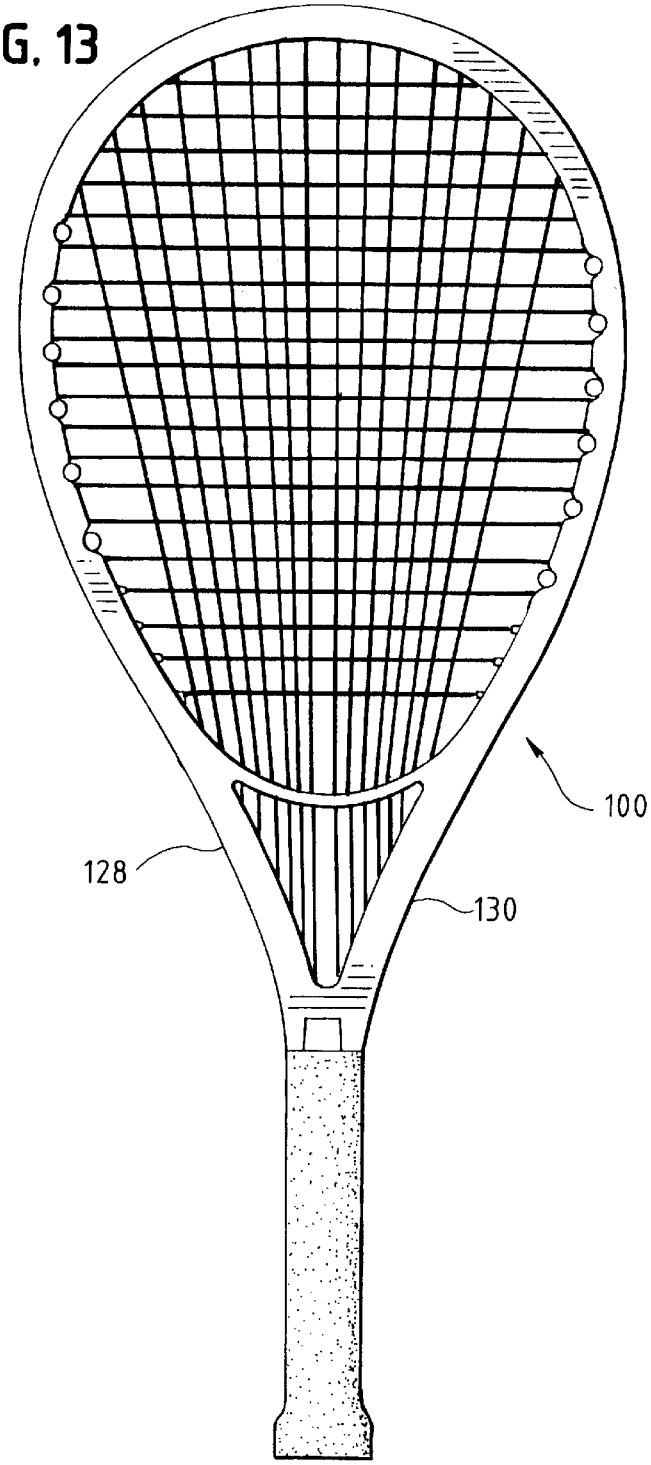
FIG. 13 is a front plan view of the racket shown in FIG. 5.

Referring to FIG. 13, the racket 100 does not include a second throat bridge. Instead, the main strings extend through string holes in the arms 128 and 130 of the throat. If desired, however, the racket 100 could include a second throat bridge like the bridge 44.

Those of ordinary skill in the art will appreciate that, while the present invention has been described with respect to certain embodiments thereof, it is not intended to be limited thereto, and variations may be made that would be considered within the scope of the following claims.

I claim:

1. An improved game racket including a racket frame having an elongated handle portion at a lower end thereof;

a head at an upper end of the racket frame, the head defining a perimeter of a string bed comprising a plurality of cross strings and a plurality of main strings interwoven with said plurality of cross strings; and a yoke portion at a lower end of said head, said yoke portion extending between a pair of arms of a generally Y-shaped throat portion connecting said head and said handle portion of the frame, and said yoke portion curving downwardly between said arms; and wherein the improvement comprises:

an elongated slot through said yoke portion, said slot having a length extending in a direction perpendicular to said plurality of main strings, at least two of said main strings passing through said elongated slot, and said slot further having a width perpendicular to said string bed, said width being substantially larger than a string diameter of said main strings, and dampening means provided in said slot.

2. The racket of claim 1, wherein said dampening means includes a first layer of a dampening material located between said first sidewall of the slot and a first side of said at least two racket strings passing through said slot.

3. The racket of claim 2, wherein the dampening material is polyurethane.

4. The racket of claim 2, wherein said dampening means further includes a second layer of dampening material located between said second sidewall of the slot and a second side of said at least two racket strings passing through the slot, opposite said first side of the two racket strings.

5. The racket of claim 4, wherein said second layer of the dampening material is spaced apart from said first layer of dampening material.

6. The racket of claim 1, wherein said dampening means is a soft insert substantially filling said slot, said soft insert including a plurality of string-receiving openings therethrough, each of said openings being of a smaller diameter than the diameter of each of said at least two racket strings passing through said slot prior to insertion of the at least two racket strings through the slot, whereby a force fit is created between said at least two racket strings and said soft insert.

7. The racket of claim 6, wherein said insert is polyurethane.

8. An improved game racket including a racket frame having an elongated handle portion at a lower end thereof;

a head at an upper end of the racket frame, the head defining a perimeter of a string bed comprising a plurality of cross strings and a plurality of main strings interwoven with said plurality of cross strings; and a yoke portion at a lower end of said head, said yoke portion extending between a pair of arms of a generally Y-shaped throat portion connecting said head and said handle portion of the frame, and said yoke portion curving downwardly between said arms; and wherein the improvement comprises:

an elongated slot through said yoke portion, said slot having a length extending in a direction perpendicular to said plurality of main strings, at least two of said main strings passing through said elongated slot, a dampening means provided in the slot, and said slot further having a width perpendicular to said string bed, said width being substantially larger than a string diameter of said main strings;

said dampening means including a first layer of a dampening material located between a first sidewall of said slot and a first side of said at least two racket strings passing through said slot; and wherein said dampening means further includes a second layer of the dampening material located between a second sidewall of said slot and a second side of said at least two racket strings passing through the slot, opposite said first side of the two racket strings.

9. The racket of claim 8, wherein said second layer of the dampening material is spaced apart from said first layer of dampening material.

10. An improved game racket including a racket frame having an elongated handle portion at a lower end thereof;

a head at an upper end of the racket frame, the head defining a perimeter of a string bed comprising a plurality of cross strings and a plurality of main strings interwoven with said plurality of cross strings; and a yoke portion at a lower end of said head, said yoke portion extending between a pair of arms of a generally Y-shaped throat portion connecting said head and said handle portion of the frame, and said yoke portion curving downwardly between said arms; and wherein the improvement comprises:

an elongated slot through said yoke portion, said slot having a length extending in a direction perpendicular to said plurality of main strings, at least two of said main strings passing through said elongated slot, a dampening means provided in the slot, and said slot further having a width perpendicular to said string bed, said width being substantially larger than a string diameter of said main strings; and said dampening means being a soft insert substantially filling said slot, said soft insert including a plurality of string-receiving openings therethrough, each of said openings being of a smaller diameter than the diameter of each of said at least two racket strings passing through said slot prior to insertion of the at least two racket strings through the slot, whereby a force fit is created between said at least two racket strings and said soft insert.

11. The racket of claim 10, wherein said insert is polyurethane.

* * * * *